US009482122B2

(12) United States Patent
Moon et al.

(10) Patent No.: US 9,482,122 B2
(45) Date of Patent: Nov. 1, 2016

(54) DETENT ASSEMBLY AND A METHOD OF ASSEMBLING THE DETENT ASSEMBLY

(71) Applicant: GM GLOBAL TECHNOLOGY OPERATIONS LLC, Detroit, MI (US)

(72) Inventors: Joseph J. Moon, Beverly Hills, MI (US); Patrick J. Tow, Rochester Hills, MI (US); Domenic Certo, Niagara Falls (CA)

(73) Assignee: GM Global Technology Operations LLC, Detroit, MI (US)

( * ) Notice: Subject to any disclaimer, the term of this patent is extended or adjusted under 35 U.S.C. 154(b) by 107 days.

(21) Appl. No.: 14/319,582

(22) Filed: Jun. 30, 2014

(65) Prior Publication Data

US 2015/0377094 A1 Dec. 31, 2015

(51) Int. Cl.
*F01L 1/34* (2006.01)
*F01L 13/00* (2006.01)

(52) U.S. Cl.
CPC .... *F01L 13/0036* (2013.01); *F01L 2013/0052* (2013.01); *F01L 2013/0078* (2013.01)

(58) Field of Classification Search
CPC ..... F01L 13/0036; F01L 2013/0078; F01L 2013/0052
USPC ..... 123/90.16, 90.18
See application file for complete search history.

(56) References Cited

U.S. PATENT DOCUMENTS

2011/0247577 A1* 10/2011 Elendt ..... F01L 13/0036 123/90.18

OTHER PUBLICATIONS

2 Catalog pages from the Monroe Engineering website: http://catalog.monroeengineering.com/category/press - fit - plungers; retrieval date Apr. 2014.

* cited by examiner

*Primary Examiner* — Zelalem Eshete
(74) *Attorney, Agent, or Firm* — Quinn Law Group, PLLC

(57) ABSTRACT

A detent assembly and a method of assembling the detent assembly are disclosed. The detent assembly includes a first shaft rotatable about a longitudinal axis and has an outer surface. The first shaft defines a cavity having an opening defined by the outer surface. The detent assembly further includes a camshaft defining an aperture along the longitudinal axis to present an inner wall of the camshaft that circumscribes the longitudinal axis. The inner wall defines a plurality of recesses spaced from each other. The detent assembly also includes a self-contained plunger unit that is secured to the first shaft in the cavity as a unit. A plunger of the self-contained plunger unit engages the inner wall as the camshaft is disposed over the self-contained plunger unit so that the plunger rests in one of the recesses of the camshaft to selectively secure together the first shaft and the camshaft.

19 Claims, 2 Drawing Sheets

DETENT ASSEMBLY AND A METHOD OF ASSEMBLING THE DETENT ASSEMBLY

TECHNICAL FIELD

The present disclosure relates to a detent assembly and a method of assembling the detent assembly.

BACKGROUND

Some vehicles have an internal combustion engine that combusts a mixture of air and fuel within one or more combustion chambers to produce a mechanical output. The internal combustion engine can include a sliding camshaft that controls how much the valves in the engine are opened, which controls the fuel/air mixture that is combusted to produce the mechanical output.

The sliding camshaft includes a camshaft lobe that is slidable over a base shaft. The base shaft defines a hole that receives a spring before the camshaft lobe is slid over the base shaft. After the spring is placed into the hole, a ball is disposed over the spring and a tool is utilized to press the ball into the hole to compress the spring. As the tool maintains the position of the ball in the hole, the camshaft lobe is slid over the base shaft. Once the camshaft lobe is in the desired position over the base shaft, the tool can be removed. The spring and the ball are completely separate components and positioning these components relative to each other, and utilizing the tool, can be cumbersome.

SUMMARY

The present disclosure provides a detent assembly including a first shaft rotatable about a longitudinal axis and having an outer surface. The first shaft defines a cavity having an opening defined by the outer surface. The detent assembly further includes a camshaft defining an aperture along the longitudinal axis to present an inner wall of the camshaft that circumscribes the longitudinal axis. The inner wall defines a plurality of recesses spaced from each other. The detent assembly also includes a self-contained plunger unit that is secured to the first shaft in the cavity as a unit. A plunger of the self-contained plunger unit engages the inner wall as the camshaft is disposed over the self-contained plunger unit so that the plunger rests in one of the recesses of the camshaft to selectively secure together the first shaft and the camshaft.

The present disclosure also provides a method of assembling a detent assembly. A self-contained plunger unit is secured to a first shaft in a cavity of the first shaft, with the self-contained plunger unit including a plunger. A camshaft is disposed over the first shaft and the plunger biases against an inner wall of the camshaft as the camshaft is disposed over the first shaft. The plunger rests in one of a plurality of recesses of the inner wall of the camshaft to selectively secure together the first shaft and the camshaft.

Utilizing the self-contained plunger unit of the detent assembly eliminates the need for the tool as discussed in the background section. Eliminating the tool can simplify assembly of the components and can reduce assembly time. Also, utilizing the self-contained plunger unit of the detent assembly can ensure repeatability of placement of the plunger.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that terms such as "above", "below", "upward", "up", "downward", "down", "top", "bottom", "left", "right", "back", "forth", etc., are used descriptively for the figures, and do not represent limitations on the scope of the disclosure, as defined by the appended claims.

Figure 1:
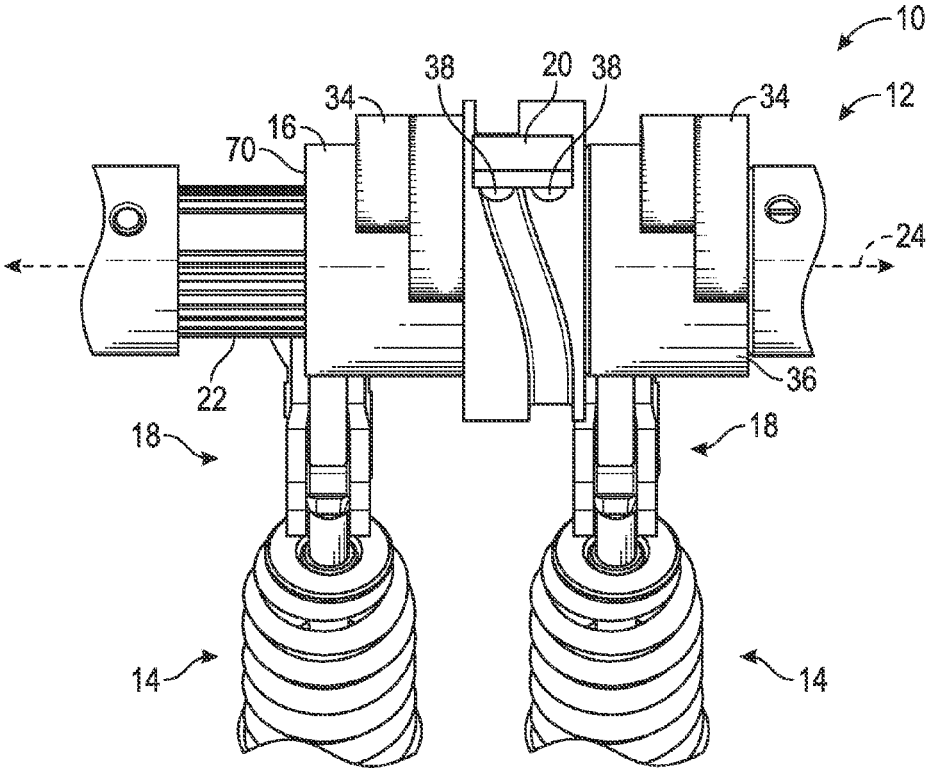
FIG. 1 is a schematic perspective fragmentary view of an engine.
Figure 2:
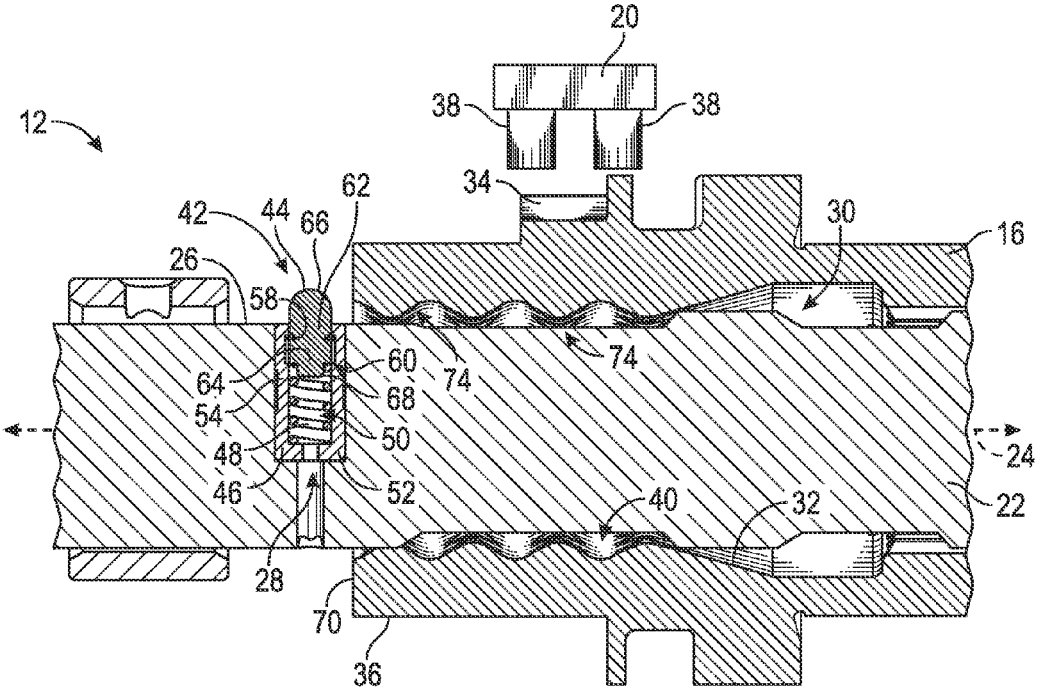
FIG. 2 is a schematic fragmentary cross-sectional view of a detent assembly, with a camshaft and a first shaft in a preassembled position, and illustrating a self-contained plunger unit of a first configuration.
Figure 3:
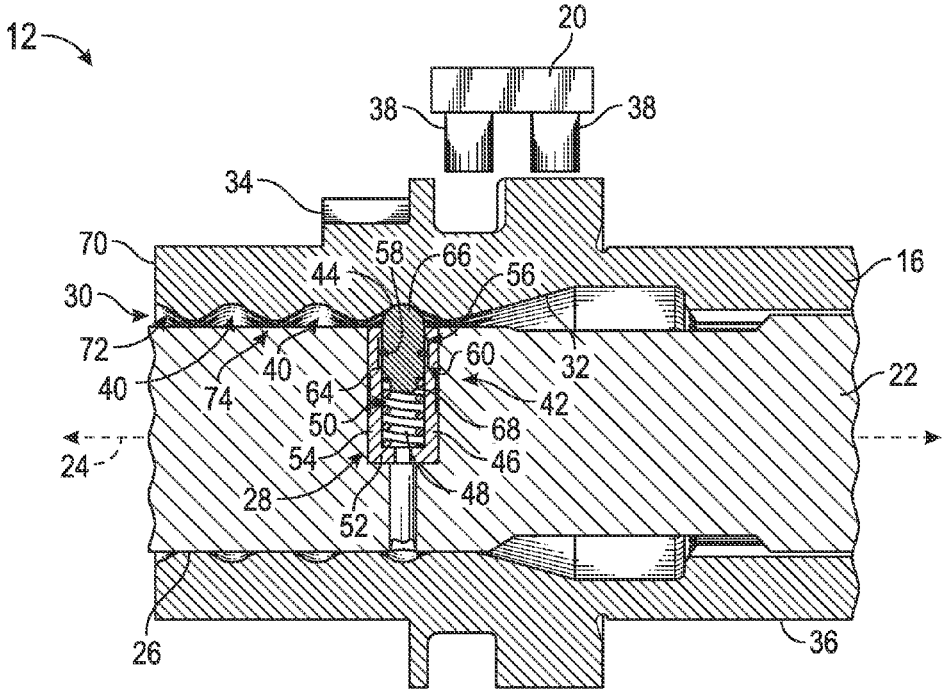
FIG. 3 is a schematic fragmentary cross-sectional view of the detent assembly, with the camshaft and the first shaft in an assembled position, and illustrating the self-contained plunger unit of the first configuration.

Referring to the Figures, wherein like numerals indicate like or corresponding parts throughout the several views, an engine 10 for a vehicle is generally shown in FIG. 1 and a detent assembly 12 is generally shown in FIGS. 2 and 3.

The vehicle can be an automotive vehicle, such as, a car, a truck, etc. It is to be appreciated that the vehicle can alternatively be a non-automotive vehicle, such as, a farm vehicle, a marine vehicle, an aviation vehicle, etc. The engine 10 can be an internal combustion engine that combusts a mixture of air and fuel within one or more combustion chambers to produce a mechanical output. It is to be appreciated that the engine 10 can be any suitable engine that can utilize the detent assembly 12 described herein. The engine 10 can include a crankshaft, a plurality of valves 14, a camshaft 16, a plurality of pistons, a plurality of pushrods, a plurality of rocker arms 18, an actuator 20, and various other components to create the mechanical output.

The engine 10 can utilize the detent assembly 12. Referring to FIGS. 1-3, the detent assembly 12 includes a first shaft 22 rotatable about a longitudinal axis 24. The first shaft 22 can be coupled to the crankshaft such that rotational movement is transferred between the crankshaft and the first shaft 22. Specifically, torque can be transferred between the crankshaft and the first shaft 22. For example, the first shaft 22 can be driven by the crankshaft. The first shaft 22 can also be referred to as a base shaft.

Turning to FIGS. 2 and 3, the first shaft 22 has an outer surface 26. The outer surface 26 faces away from the longitudinal axis 24. Additionally, the first shaft 22 defines a cavity 28 having an opening defined by the outer surface 26. Therefore, the cavity 28 is accessible from the outer surface 26 of the first shaft 22.

Referring to FIGS. 1-3, the detent assembly 12 further includes the camshaft 16. The camshaft 16 and the first shaft 22 cooperate with each other. The camshaft 16 and the first shaft 22 are splined together when the camshaft 16 is disposed over the first shaft 22 at a predetermined distance, which allows the camshaft 16 and the first shaft 22 to rotate in unison or concurrently about the longitudinal axis 24. The camshaft 16 can also be referred to as a sliding camshaft lobe.

Furthermore, the camshaft 16 is selectively movable back and forth over the first shaft 22, i.e., movable along the longitudinal axis 24, which controls the rotational angle of the rocker arms 18, and the rotational angle of the rocker arms 18 controls the position of the valves 14. Specifically, the amount that the valves 14 are opened controls the fuel/air mixture that is combusted to produce the mechanical output.

Referring to FIGS. 2 and 3, the camshaft 16 defines an aperture 30 along the longitudinal axis 24 to present an inner wall 32 of the camshaft 16. Generally, the inner wall 32 circumscribes the longitudinal axis 24. The first shaft 22 is disposed in the aperture 30 such that the outer surface 26 of the first shaft 22 faces the inner wall 32 of the camshaft 16. The camshaft 16 is selectively movable back and forth relative to the first shaft 22. In other words, the camshaft 16 can selectively move along the longitudinal axis 24, i.e., axially, relative to the first shaft 22. By changing the position of the camshaft 16 relative to the first shaft 22, the opening of the valves 14 correspondingly change. The camshaft 16 and the first shaft 22 can be referred to as a sliding camshaft. In other words, the sliding camshaft includes the camshaft 16 and the first shaft 22.

The camshaft 16 can include a plurality of cams 34 (see FIG. 1) spaced from each other and disposed on an outer wall 36 of the camshaft 16. The outer wall 36 opposes the inner wall 32. The outer wall 36 faces away from the longitudinal axis 24. The cams 34 can be eccentric and each of the cams 34 can engage or abut respective rocker arms 18. The rocker arms 18 cooperate with respective valves 14 to open/close the valves 14. The actuator 20 can include one or more rods 38 selectively engaging the outer wall 36 of the camshaft 16.

Continuing with FIGS. 2 and 3, the inner wall 32 defines a plurality of recesses 40 spaced from each other. It is to be appreciated that the inner wall 32 can define any number of recesses 40, i.e., one or more. The recesses 40 will be discussed further below.

Again, continuing with FIGS. 2 and 3, the detent assembly 12 also includes a self-contained plunger unit 42 that is secured to the first shaft 22 in the cavity 28 as a unit 42. The self-contained plunger unit 42 also includes a plunger 44 engaging the inner wall 32 as the camshaft 16 is disposed over the self-contained plunger unit 42 so that the plunger 44 rests in one of the recesses 40 of the camshaft 16 to selectively secure together the first shaft 22 and the camshaft 16.

The self-contained plunger unit 42 can include a housing 46 secured to the first shaft 22 in the cavity 28 and a biasing member 48 contained in the housing 46. The self-contained plunger unit 42, and more specifically, the housing 46 can be secured to the first shaft 22 in the cavity 28 by any suitable method, such as for example, a friction fit, an interference fit, a press fit, a slip fit, adhesive, etc.

The plunger 44 is movably coupled to the housing 46 and continuously biased outwardly away from the longitudinal axis 24 by the biasing member 48. A portion of the plunger 44 protrudes outwardly beyond the outer surface 26 of the first shaft 22 away from the longitudinal axis 24 when the inner wall 32 is spaced from the self-contained plunger unit 42 (see FIG. 2). As shown in FIG. 2, the plunger 44 remains movably coupled to the housing 46. In other words, the plunger 44 remains movably coupled to the housing 46 even when the plunger 44 protrudes beyond the outer surface 26.

The plunger 44 and the biasing member 48 are preassembled with the housing 46 to define the self-contained plunger unit 42. Therefore, the entire unit 42 is disposed in the cavity 28 of the first shaft 22 at one time, which reduces the number of parts to be assembled, and thus, reduces assembly time. Also, utilizing the self-contained plunger unit 42 simplifies assembly and ensures repeatability of the placement of the plunger 44. Furthermore, the space or clearance between the inner wall 32 of the camshaft 16 and the outer surface 26 of the first shaft 22 can be reduced because these components do not have to be designed to fit the tool (as discussed in the background section) therebetween. Therefore, the thickness of the first shaft 22 and/or the camshaft 16 can be increased by utilizing this detent assembly 12 which can improve the stiffness of the first shaft 22 and/or the camshaft 16.

The plunger 44 is continuously biasing outwardly by the biasing member 48 such that the plunger 44 engages the inner wall 32 as the camshaft 16 is disposed over the plunger 44. Specifically, the plunger 44 is biasable back and forth relative to the housing 46 as the camshaft 16 moves back and forth along the longitudinal axis 24 over the plunger 44. Specifically, the plunger 44 moves radially back and forth relative to the longitudinal axis 24 while the camshaft 16 moves axially back and forth relative to the longitudinal axis 24. Simply stated, the plunger 44 can retract and extend. The plunger 44 rests in one of the recesses 40 of the camshaft 16 to secure together the first shaft 22 and the camshaft 16. Specifically, the plunger 44 selectively secures the camshaft 16 in an axial position relative to the first shaft 22. Moving the camshaft 16 along the longitudinal axis 24 changes the position of the cams 34 relative to respective rocker arms 18, which rotates the rocker arms 18 to another angular position, and thus, how much the valves 14 are open/close. When the plunger 44 is inserted into the aperture 30 of the camshaft 16, the camshaft 16 and the first shaft 22 become splined together such that the camshaft 16 and the first shaft 22 rotate in unison or concurrently about the longitudinal axis 24.

For example, when there are three recesses 40, the plunger 44 can secure the camshaft 16 in three different positions relative to the first shaft 22 along the longitudinal axis 24. Axial movement of the camshaft 16 causes the plunger 44 to rest in one of the recesses 40 and does not affect the camshaft 16 and the first shaft 22 being splined together during operation of the engine 10. In other words, once assembled, the camshaft 16 and the first shaft 22 remain splined together to rotate in unison even when the camshaft 16 moves axially along the longitudinal axis 24 such that the plunger 44 rests in a different recess 40. Depending on which of the three recesses 40 the plunger 44 is disposed in, the valve 14 can be in a high lift position, a low lift position or a no lift position, each of which changes how much the valves 14 are opened. As discussed above, more or less recesses 40 can be utilized depending on how many positions are desired to open/close the valves 14.

Figure 4:
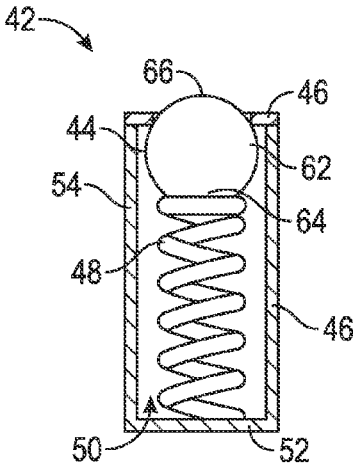
FIG. 4 is a schematic cross-sectional view of a self-contained plunger unit of a second configuration.

The self-contained plunger unit 42 can be any suitable configuration and two suitable examples are shown in the Figures. Specifically, FIGS. 2 and 3 illustrate a first configuration of the self-contained plunger unit 42 and FIG. 4 illustrates a second configuration of the self-contained plunger unit 42. The common and different features of these self-contained plunger units 42 are discussed below.

Referring to FIGS. 2-4, the housing 46 defines a chamber 50 that receives the biasing member 48 and the plunger 44. The housing 46 can include a bottom wall 52 inside the chamber 50. Furthermore, the housing 46 can include a side wall 54 adjacent to the bottom wall 52 inside the chamber 50. Therefore, the side wall 54 and the bottom wall 52 cooperate, with the chamber 50 being adjacent to these walls 52, 54. As shown in FIGS. 2-4, the biasing member 48 is contained in the chamber 50 by the bottom wall 52 and the plunger 44. Furthermore, the biasing member 48 is contained in the chamber 50 by the side wall 54. Simply stated, the biasing member 48 is packaged in the housing 46.

Referring to FIGS. 2 and 3, the housing 46 can include a first step 56 disposed in the chamber 50. Specifically, the side wall 54 can include the first step 56. The plunger 44 can include a lip 58 extending outwardly toward the housing 46. Specifically, the lip 58 extends outwardly toward the side wall 54. The lip 58 can selectively engage the first step 56 to limit movement of the plunger 44 out of the chamber 50 such that the plunger 44 remains movably coupled to the housing 46.

Continuing with FIGS. 2 and 3, the housing 46 can further include a second step 60 disposed in the chamber 50 and spaced from the first step 56. Specifically, the side wall 54 can include the second step 60. The lip 58 of the plunger 44 can selectively engage the second step 60 to limit movement of the plunger 44 into the chamber 50.

Referring to FIGS. 2-4, the plunger 44 can include a body 62 having a base 64 engaging the biasing member 48 and an engagement end 66 facing outwardly away from the base 64 to selectively dispose the engagement end 66 into one of the recesses 40 of the camshaft 16. Therefore, when the camshaft 16 is disposed over the self-contained plunger unit 42, the engagement end 66 engages the inner surface of the camshaft 16. As shown in FIGS. 2-4, the engagement end 66 can have an arcuate configuration. The engagement end 66 can be arcuate, curved, circular, sloped, ramped or any other suitable configuration to selectively secure the camshaft 16 and the first shaft 22 together.

Turning to FIGS. 2 and 3, the base 64 can include a protrusion 68 extending outwardly away from the engagement end 66 to define a spring seat for the biasing member 48. The biasing member 48 for this embodiment can be a spring. In one embodiment, the biasing member 48 can be defined as a coil spring.

Turning to FIG. 4, the plunger 44 can be defined as a ball and the biasing member 48 can be a spring. In one embodiment, the biasing member 48 can be defined as a coil spring. In this embodiment, the diameter of the top portion of the chamber 50, adjacent to the outer surface 26 when the unit 42 is secured to the first shaft 22, is less than the maximum diameter of the ball, which maintains the ball movably coupled to the housing 46.

Turning back to FIGS. 2 and 3, the camshaft 16 can include a first end 70 and the inner wall 32 of the camshaft 16 can include a first ramp 72 extending from the first end 70 of the camshaft 16 into the aperture 30 such that the plunger 44 is movable when engaging the first ramp 72 to dispose the camshaft 16 over the self-contained plunger unit 42. FIG. 2 illustrates the first shaft 22 and the camshaft 16 in a preassembled position, in which the camshaft 16 is spaced from the self-contained plunger unit 42 such that the plunger 44 is biased outwardly to a maximum position beyond the outer surface 26 of the first shaft 22. When the camshaft 16 moves along the longitudinal axis 24 toward the self-contained plunger unit 42, the plunger 44, and more specifically, the engagement end 66 engages the first ramp 72 which causes the plunger 44 to move back or retract into the chamber 50. In other words, when the camshaft 16 is slid relative to the first shaft 22 toward the self-contained plunger unit 42, the engagement end 66 engages the first ramp 72.

The camshaft 16 can include a plurality of second ramps 74 adjacent to respective recesses 40 to allow the plunger 44 to move back and forth, i.e., retract and extend, into one of the recesses 40 as the camshaft 16 moves along the longitudinal axis 24. One of the second ramps 74 cooperates with the first ramp 72 to allow the plunger 44 to move from the first ramp 72 to the second ramp 74. FIG. 3 illustrates the first shaft 22 and the camshaft 16 in an assembled position, in which the plunger 44 is disposed in one of the recesses 40 such that the self-contained plunger unit 42 is disposed between the camshaft 16. Specifically, the self-contained plunger unit 42 is disposed in the aperture 30 of the camshaft 16 when in the assembled position.

The plunger 44 is disposed in one of the recesses 40 to selectively secure the axial position of the camshaft 16 and the cams 34 relative to the first shaft 22. When in the assembled position, the plunger 44 is biased outwardly beyond the outer surface 26 of the first shaft 22 into one of the recesses 40. The biasing member 48 can be configured to apply the desired amount of radial force to the plunger 44, which applies the desired amount of radial force to the inner wall 32 of the camshaft 16 in the recess 40 to secure together the camshaft 16 and the first shaft 22. The radial force is applied by the biasing member 48 radially relative to the longitudinal axis 24, i.e., transverse to the longitudinal axis 24. An axial force is applied to the camshaft 16 to move the camshaft 16 along the longitudinal axis 24 and this axial force overcomes the radial force which allows the plunger 44 to move back and forth into different recesses 40. The radial force applied to the inner wall 32 in the recess 40 is large enough to maintain the desired position of the camshaft 16 relative to the first shaft 22 during operation of the engine 10.

When the camshaft 16 moves along the longitudinal axis 24 toward the self-contained plunger unit 42, the plunger 44, and more specifically, the engagement end 66 engages the first ramp 72 which causes the plunger 44 to move back into the chamber 50, i.e., retract, and as the camshaft 16 continues to move along the longitudinal axis 24, the plunger 44 moves forward, i.e., extends, as the engagement end 66 engages the second ramp 74 until the plunger 44 rests in the recess 40. If another recess 40 is desired, the plunger 44 moves back and forth along the next second ramp(s) 74 until the plunger 44 rests in the next recess 40, and so on until the desired position of the camshaft 16 is reached. Therefore, the plunger 44 and the recesses 40 cooperate to maintain the desired axial position of the camshaft 16 relative to the first shaft 22.

Figure 5:
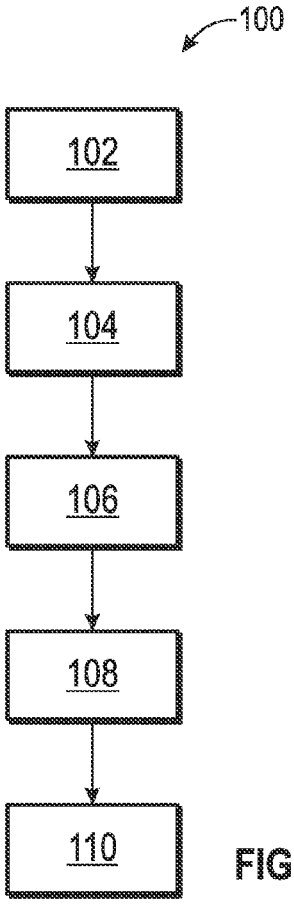
FIG. 5 is a schematic flowchart of a method of assembling the detent assembly.

Referring to FIG. 5, the present disclosure also provides a method 100 of assembling the detent assembly 12.

At block 102, the self-contained plunger unit 42 is secured to the first shaft 22 in the cavity 28 of the first shaft 22. In certain embodiments, securing the self-contained plunger unit 42 to the first shaft 22 further includes securing the housing 46 of the self-contained plunger unit 42 to the first shaft 22 in the cavity 28. As discussed above, the self-contained plunger unit 42 includes the plunger 44.

At block 104, the camshaft 16 is disposed over the first shaft 22. In certain embodiments, disposing the camshaft 16 over the first shaft 22 further includes disposing the first shaft 22 through the aperture 30 of the camshaft 16. Disposing the camshaft 16 over the first shaft 22 can further including moving the camshaft 16 over the first shaft 22. Therefore, the camshaft 16 can be slid over the first shaft 22 such that the first shaft 22 is inserted into the aperture 30. Simply stated, the first shaft 22 can be slid into the aperture 30 of the camshaft 16. The camshaft 16 is spaced from the self-contained plunger unit 42 when the camshaft 16 is initially disposed over the first shaft 22, i.e., in the preassembled position.

At block 106, the plunger 44 is biased against the inner wall 32 of the camshaft 16 as the camshaft 16 is disposed over the first shaft 22. Therefore, as the camshaft 16 continues to be disposed over the first shaft 22, the self-contained plunger unit 42 is inserted into the aperture 30 of the camshaft 16 such that the plunger 44 engages with the inner wall 32. Specifically, the plunger 44 engages the first ramp 72 at the first end 70 of the camshaft 16 as the camshaft 16 continues to move over the first shaft 22. Then the plunger 44 engages the second ramp 74 as the camshaft 16 continues to be disposed or moved over the first shaft 22. Even more specifically, the engagement end 66 of the plunger 44 engages the first ramp 72 and the second ramp 74.

At block 108, the plunger 44 rests in one of the plurality of recesses 40 of the inner wall 32 of the camshaft 16 to selectively secure together the first shaft 22 and the camshaft 16. Therefore, the camshaft 16 continues to be disposed over the first shaft 22 until the plunger 44 is positioned into the desired recess 40. When the plunger 44 rests in the desired recess 40, the camshaft 16 is secured to the first shaft 22 in the axial position, i.e., along the longitudinal axis 24. In other words, the camshaft 16 will remain in the axial position relative to the first shaft 22 until the axial force overcomes the radial force applied by the plunger 44 which causes the plunger 44 to move and allows the camshaft to move along the longitudinal axis 24 to another axial position relative to the first shaft 22.

The first shaft 22 and the camshaft 16 can rotate in unison when the plunger 44 rests or is positioned in one of the recesses 40. Specifically, the first shaft 22 and the camshaft 16 are splined together to rotate about the longitudinal axis 24 in unison. The splined engagement between the first shaft 22 and the camshaft 16 is configured such that the camshaft 16 can move axially relative to the first shaft 22 between recesses 40 while maintaining this splined connection.

At block 110, the plunger 44 is continuously biased outwardly by the biasing member 48 of the self-contained plunger unit 42 while the plunger 44 remains movably coupled to the housing 46. Therefore, the plunger 44 is continuously biased outwardly before and after securing the camshaft 16 and the first shaft 22 together. As such, the plunger 44 is movable back and forth relative to the housing 46 due to the biasing member 48.

It is to be appreciated that the order or sequence of performing the method 100 as identified in the flowchart of FIG. 5 is for illustrative purposes and other orders or sequences are within the scope of the present teachings. It is to also be appreciated that the method 100 can include other features not specifically identified in the flowchart of FIG. 5.

While the best modes for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A detent assembly comprising:

a first shaft rotatable about a longitudinal axis and having an outer surface, with the first shaft defining a cavity having an opening defined by the outer surface;

a camshaft defining an aperture along the longitudinal axis to present an inner wall of the camshaft that circumscribes the longitudinal axis, with the inner wall defining a plurality of recesses spaced from each other; and a self-contained plunger unit that is secured to the first shaft in the cavity as a unit, with a plunger of the self-contained plunger unit engaging the inner wall as the camshaft is disposed over the self-contained plunger unit so that the plunger rests in one of the recesses of the camshaft to selectively secure together the first shaft and the camshaft;

wherein the self-contained plunger unit includes a housing secured to the first shaft in the cavity, and wherein the plunger is movably coupled to the housing.

2. An assembly as set forth in claim 1 wherein the self-contained plunger unit includes a biasing member contained in the housing, with the plunger continuously biased outwardly away from the longitudinal axis by the biasing member, and with a portion of the plunger protruding outwardly beyond the outer surface of the first shaft away from the longitudinal axis when the inner wall is spaced from the self-contained plunger unit while remaining movably coupled to the housing.

3. An assembly as set forth in claim 2 wherein the housing defines a chamber that receives the biasing member and the plunger.

4. An assembly as set forth in claim 3 wherein the housing includes a bottom wall inside the chamber, with the biasing member contained in the chamber by the bottom wall and the plunger.

5. An assembly as set forth in claim 3 wherein the housing includes a first step disposed in the chamber, and wherein the plunger includes a lip extending outwardly toward the housing, with the lip selectively engaging the first step to limit movement of the plunger out of the chamber such that the plunger remains movably coupled to the housing.

6. An assembly as set forth in claim 5 wherein the housing includes a second step disposed in the chamber and spaced from the first step, with the lip of the plunger selectively engaging the second step to limit movement of the plunger into the chamber.

7. An assembly as set forth in claim 4 wherein the plunger includes a body having a base engaging the biasing member and an engagement end facing outwardly away from the base to selectively dispose the engagement end into one of the recesses of the camshaft.

8. An assembly as set forth in claim 7 wherein the engagement end has an arcuate configuration.

9. An assembly as set forth in claim 7 wherein the base includes a protrusion extending outwardly away from the engagement end to define a spring seat for the biasing member.

10. An assembly as set forth in claim 9 wherein the biasing member is defined as a coil spring.

11. An assembly as set forth in claim 7 wherein the plunger is defined as a ball.

12. An assembly as set forth in claim 11 wherein the biasing member is defined as a coil spring.

13. An assembly as set forth in claim 1 wherein the camshaft includes a first end and the inner wall of the camshaft includes a first ramp extending from the first end of the camshaft into the aperture such that the plunger is movable when engaging the first ramp to dispose the camshaft over the self-contained plunger unit.

14. An assembly as set forth in claim 13 wherein the camshaft includes a plurality of second ramps adjacent to respective recesses to allow the plunger to move back and forth into one of the recesses as the camshaft moves along the longitudinal axis.

15. An assembly as set forth in claim 1 wherein the camshaft includes a plurality of cams spaced from each other and disposed on an outer wall of the camshaft, with the outer wall opposing the inner wall, and wherein the plunger is disposed in one of the recesses to selectively secure an axial position of the camshaft and the cams relative to the first shaft.

16. A method of assembling a detent assembly, the method comprising:

securing a self-contained plunger unit to a first shaft in a cavity of the first shaft, with the self-contained plunger unit including a plunger;

disposing a camshaft over the first shaft;

biasing the plunger against an inner wall of the camshaft as the camshaft is disposed over the first shaft; and resting the plunger in one of a plurality of recesses of the inner wall of the camshaft to selectively secure together the first shaft and the camshaft;

wherein securing the self-contained plunger unit to the first shaft further comprises securing a housing of the self-contained plunger unit to the first shaft in the cavity.

17. A method as set forth in claim 16 further comprising continuously biasing the plunger outwardly by a biasing member of the self-contained plunger unit while the plunger remains movably coupled to the housing.

18. A method as set forth in claim 16 wherein disposing the camshaft over the first shaft further comprises disposing the first shaft through an aperture of the camshaft.

19. A detent assembly comprising:

a first shaft rotatable about a longitudinal axis and having an outer surface, with the first shaft defining a cavity having an opening defined by the outer surface;

a camshaft defining an aperture along the longitudinal axis to present an inner wall of the camshaft that circumscribes the longitudinal axis, with the inner wall defining a plurality of recesses spaced from each other; and a self-contained plunger unit that is secured to the first shaft in the cavity as a unit, with a plunger of the self-contained plunger unit engaging the inner wall as the camshaft is disposed over the self-contained plunger unit so that the plunger rests in one of the recesses of the camshaft to selectively secure together the first shaft and the camshaft;

wherein the self-contained plunger unit includes a housing secured to the first shaft in the cavity and a biasing member contained in the housing, with the plunger movably coupled to the housing and continuously biased outwardly by the biasing member.

* * * * *